US009508219B2

(12) United States Patent
Garvey et al.

(10) Patent No.: US 9,508,219 B2
(45) Date of Patent: Nov. 29, 2016

(54) DYNAMIC MANAGEMENT OF WAGERING GAME AVAILABILITY

(75) Inventors: Jesse L. Garvey, Chicago, IL (US); Damon E. Gura, Chicago, IL (US); Jason A. Smith, Vernon Hills, IL (US); Craig J. Sylla, Round Lake, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 911 days.

(21) Appl. No.: 12/753,618

(22) Filed: Apr. 2, 2010

(65) Prior Publication Data

US 2010/0255901 A1 Oct. 7, 2010

Related U.S. Application Data

(60) Provisional application No. 61/166,469, filed on Apr. 3, 2009.

(51) Int. Cl.
*A63F 9/24* (2006.01)
*G07F 17/32* (2006.01)

(52) U.S. Cl.
CPC ..... *G07F 17/3239* (2013.01); *G07F 17/32* (2013.01); *G07F 17/3223* (2013.01); *G07F 17/3225* (2013.01); *G07F 17/3227* (2013.01);
(Continued)

(58) Field of Classification Search
CPC ..... G07F 17/3223; G07F 17/3225; G07F 17/3227; G07F 17/32
USPC ..... 463/16, 20, 25, 27, 42, 1, 43; 273/292, 273/274, 142 H
See application file for complete search history.

(56) References Cited

U.S. PATENT DOCUMENTS 5,971,851 A * 10/1999 Pascal et al. ..... 463/24
6,595,856 B1 7/2003 Ginsburg et al.
(Continued)

FOREIGN PATENT DOCUMENTS

WO WO2007032943 3/2007
WO WO2007109168 9/2007
(Continued)

OTHER PUBLICATIONS

U.S. Appl. No. 13/277,995, filed Oct. 20, 2011, Burke, Mary M., et al.
(Continued)

*Primary Examiner* — David L Lewis
*Assistant Examiner* — Chase Leichliter
(74) *Attorney, Agent, or Firm* — DeLizio Law, PLLC

(57) ABSTRACT

A wagering game system and its operations are described herein. In some embodiments, the operations can include initiating, at a wagering game server, a secondary game for presentation on a wagering game machine. The secondary game may be associated with a primary wagering game being presented on the wagering game machine. The operations can also include detecting that the secondary game becomes unavailable for play while the secondary game is being presented on the wagering game machine, and determining identification information associated with a player of the primary wagering game and the secondary game. The operations can further include generating results for the secondary game associated with the player after the secondary game is available for play, and providing an award, depending on the secondary game results, to the player using the identification information.

21 Claims, 7 Drawing Sheets

(52) U.S. Cl.
CPC ..... *G07F 17/3267* (2013.01); *G07F 17/3269* (2013.01)

(56) References Cited

U.S. PATENT DOCUMENTS

| | | | | |
|---|---|---|---|---|
| 6,800,027 | B2 * | 10/2004 | Giobbi et al. | 463/24 |
| 6,884,174 | B2 | 4/2005 | Lundy et al. | |
| 6,890,259 | B2 | 5/2005 | Breckner et al. | |
| 7,192,352 | B2 * | 3/2007 | Walker | A63F 13/12 273/429 |
| 7,201,660 | B2 | 4/2007 | Kiely et al. | |
| 7,207,883 | B2 * | 4/2007 | Nozaki et al. | 463/24 |
| 7,278,068 | B1 * | 10/2007 | Crowder, Jr. | 714/100 |
| 7,311,598 | B2 * | 12/2007 | Kaminkow et al. | 463/16 |
| 7,682,245 | B2 | 3/2010 | Nguyen | |
| 7,972,214 | B2 * | 7/2011 | Kinsley et al. | 463/42 |
| 8,079,902 | B2 * | 12/2011 | Michaelson et al. | 463/20 |
| 2003/0013512 | A1 | 1/2003 | Rowe | |
| 2004/0002385 | A1 * | 1/2004 | Nguyen | G07F 17/32 463/42 |
| 2007/0167229 | A1 * | 7/2007 | LeMay et al. | 463/29 |
| 2007/0202941 | A1 * | 8/2007 | Miltenberger et al. | 463/25 |
| 2008/0096646 | A1 | 4/2008 | Ishida et al. | |
| 2008/0108405 | A1 | 5/2008 | Brosnan et al. | |
| 2008/0171593 | A1 * | 7/2008 | Haga et al. | 463/25 |
| 2008/0214299 | A1 | 9/2008 | Smith et al. | |
| 2009/0036217 | A1 | 2/2009 | Blackburn et al. | |
| 2009/0117969 | A1 | 5/2009 | Englman | |
| 2009/0143136 | A1 | 6/2009 | Thomas | |
| 2009/0156303 | A1 * | 6/2009 | Kiely et al. | 463/29 |
| 2009/0186692 | A1 | 7/2009 | Thomas et al. | |
| 2009/0197660 | A1 | 8/2009 | Cramer et al. | |
| 2009/0291752 | A1 | 11/2009 | Anderson et al. | |
| 2009/0305776 | A1 | 12/2009 | Englman et al. | |
| 2010/0022299 | A1 | 1/2010 | Ryan | |
| 2010/0029369 | A1 | 2/2010 | Pacey | |
| 2010/0048293 | A1 | 2/2010 | Hornik | |
| 2010/0062841 | A1 | 3/2010 | Englman et al. | |
| 2010/0075746 | A1 | 3/2010 | Anderson et al. | |
| 2010/0075751 | A1 | 3/2010 | Garvey et al. | |
| 2010/0087256 | A1 | 4/2010 | Frattinger et al. | |
| 2010/0120504 | A1 * | 5/2010 | Larsen | G07F 17/3244 463/20 |
| 2010/0124973 | A1 * | 5/2010 | DeWaal | G07F 17/3244 463/20 |
| 2010/0216544 | A1 | 8/2010 | Hamlin | |
| 2010/0234089 | A1 * | 9/2010 | Saffari | G07F 17/34 463/20 |
| 2010/0234105 | A1 | 9/2010 | Gagner et al. | |
| 2010/0240455 | A1 | 9/2010 | Gagner et al. | |
| 2010/0248818 | A1 | 9/2010 | Aoki et al. | |
| 2010/0255900 | A1 | 10/2010 | Ansari et al. | |
| 2010/0255912 | A1 | 10/2010 | Ward et al. | |
| 2010/0261521 | A1 | 10/2010 | Oatman et al. | |
| 2010/0291998 | A1 | 11/2010 | Anderson et al. | |
| 2010/0292002 | A1 | 11/2010 | Ward et al. | |
| 2010/0317433 | A1 | 12/2010 | Ansari et al. | |
| 2011/0003637 | A1 * | 1/2011 | LeFever | 463/27 |
| 2011/0003643 | A1 | 1/2011 | Ryan et al. | |
| 2011/0034237 | A1 | 2/2011 | Schulhof et al. | |
| 2011/0045895 | A1 | 2/2011 | Gagner et al. | |
| 2011/0053672 | A1 | 3/2011 | Gagner et al. | |
| 2011/0212785 | A1 | 9/2011 | Gura et al. | |
| 2011/0224002 | A1 | 9/2011 | Burke et al. | |
| 2011/0250955 | A1 | 10/2011 | Adiraju et al. | |

FOREIGN PATENT DOCUMENTS

| | | |
|---|---|---|
| WO | WO2007139988 | 12/2007 |
| WO | WO2008060513 | 5/2008 |
| WO | WO2008103324 | 8/2008 |
| WO | WO2009061358 | 5/2009 |
| WO | WO2009097106 | 8/2009 |
| WO | WO2010019356 | 2/2010 |
| WO | WO2010056923 | 5/2010 |
| WO | WO2010088313 | 8/2010 |

OTHER PUBLICATIONS

U.S. Appl. No. 13/277,995 Office Action, Oct. 2, 2015, 17 Pages.

* cited by examiner

DYNAMIC MANAGEMENT OF WAGERING GAME AVAILABILITY

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2008, WMS Gaming, Inc.

FIELD

Embodiments of the inventive subject matter relate generally to wagering game systems, and more particularly to dynamic management of wagering game availability in wagering game systems.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments are illustrated in the Figures of the accompanying drawings in which.

DESCRIPTION OF THE EMBODIMENTS

This description of the embodiments is divided into five sections. The first section provides an introduction to some embodiments, while the second section describes example wagering game machine architectures. The third section describes example operations performed by some embodiments and the fourth section describes example wagering game machines in more detail. The fifth section presents some general comments.

Introduction

This section provides an introduction to some embodiments.

Operators of wagering game machines ("operators"), e.g., casino operators, typically want to maintain the operational state of wagering game machines in a wagering game system. In some embodiments, when a primary or secondary wagering game becomes unavailable for play in a wagering game machine, game availability management techniques can be implemented to service the wagering game without placing the wagering game machine offline. For example, if a secondary wagering game becomes unavailable for play, the game availability management techniques may allow a player to continue playing the primary wagering game while the secondary wagering game is being serviced. The game availability management techniques can also be implemented to notify the player of the unavailable status, continue to offer the player additional gaming options at the wagering game machine, generate results for the wagering game after the game is available for play, and process an award for the wagering game.

Figure 1:
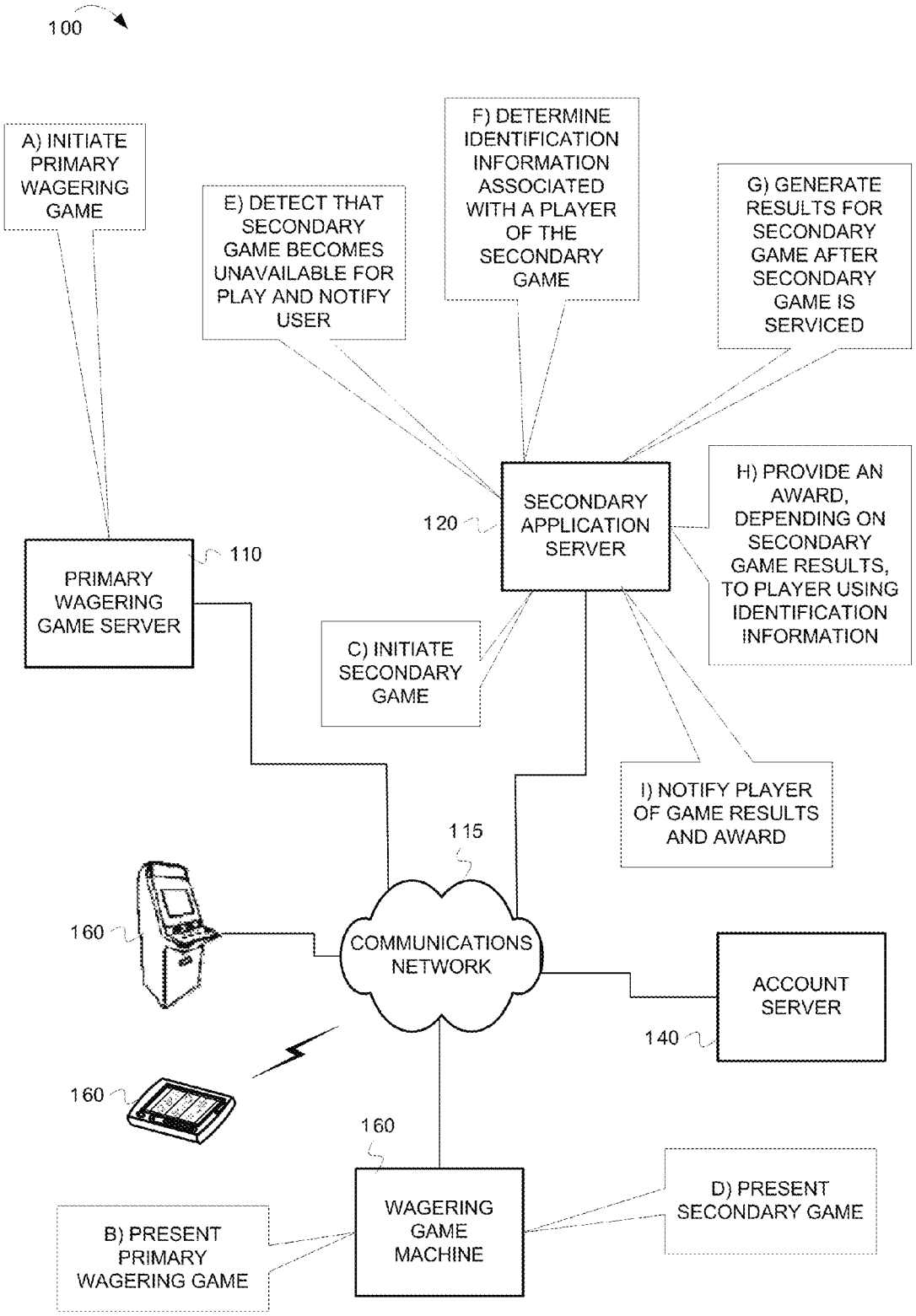
FIG. 1 is conceptual diagram that illustrates an example of processing an award for a wagering game that becomes unavailable for play, according to some embodiments.

FIG. 1 is conceptual diagram that illustrates an example of processing an award for a wagering game that becomes unavailable for play, according to some embodiments. In FIG. 1, the wagering game system 100 ("system") includes a primary wagering game server 110, a secondary applications server 120, an account server 140, and a plurality of wagering game machines 160 connected via a communication network 115. In one implementation, at stage A, the primary wagering game server 110 initiates a primary wagering game (e.g., slot games, electronic poker, electronic black jack, etc.) based on one or more player inputs detected by a wagering game machine 160. At stage B, the wagering game machine 160 presents the primary wagering game to a player, e.g. via a browser on a primary display of the wagering game machine 160. At stage C, the secondary application server 120 initiates a secondary game (e.g., a bonus game). In one example, the secondary game may be initiated after detecting a trigger event in the primary wagering game (e.g., max bet, particular game results, etc.), or detecting a player selection of a secondary game at the wagering game machine 160. At stage D, the wagering game machine 160 presents the secondary game, e.g., via a browser on the primary display and/or a secondary display of the wagering game machine 160.

At stage E, the secondary application server 120 detects that the secondary game becomes unavailable for play while the secondary game is being presented on the wagering game machine 160. For example, the secondary game may be unavailable for play due to a software failure, a hardware failure, network issues, unavailability of game content or other game resources, etc. The secondary application server 120 may also notify the player that the secondary game is unavailable, e.g., by moving the secondary game to the top right corner of the screen and displaying a graphic (or other visual indication) over the game (or the game icon) indicating the game is unavailable, by posting a message on one of the displays of the wagering game machine 160, and/or by sending the player a text message. As will be described further below, in this example, the player may have several options while the secondary game is being serviced, e.g., the player may continue playing the primary wagering game, the secondary applications server 120 can present the player another secondary game, and/or the player may move to another wagering machine 160.

At stage F, the secondary application server 120 determines identification information associated with the player of the secondary game. In one implementation, the secondary application server 120 determines an account number of an account (e.g., casino account) associated with the player of the secondary game, e.g., via a player card and the account server 140. In another implementation, the secondary application server 120 sends a message to cause the wagering game machine 160 to prompt the player for identification information, such as a casino account number, a hotel account number, and/or a name and address. At stage G, the secondary application server 120 generates results for the secondary game after the secondary game is serviced and back in working order. In some instances, this occurs after a player has left the wagering game machine. At stage H, the secondary applications server 120 provides an award, depending on the secondary game results, to the player using the identification information. For example, the secondary application server 120 can credit the award (e.g., monetary value) to the player account on the account server 140, or the secondary applications server 120 can process the award so that a check is sent to the address provided by the player. At stage I, the secondary application server 120 can notify the player of the game results and the award, e.g., via a text message or email.

Although FIG. 1 describes some embodiments, the following sections describe many other features and embodiments.

Operating Environment

This section describes example operating environments and networks and presents structural aspects of some embodiments. More specifically, this section includes discussion about wagering game system architectures.

Wagering Game Machine Architectures

Figure 2:
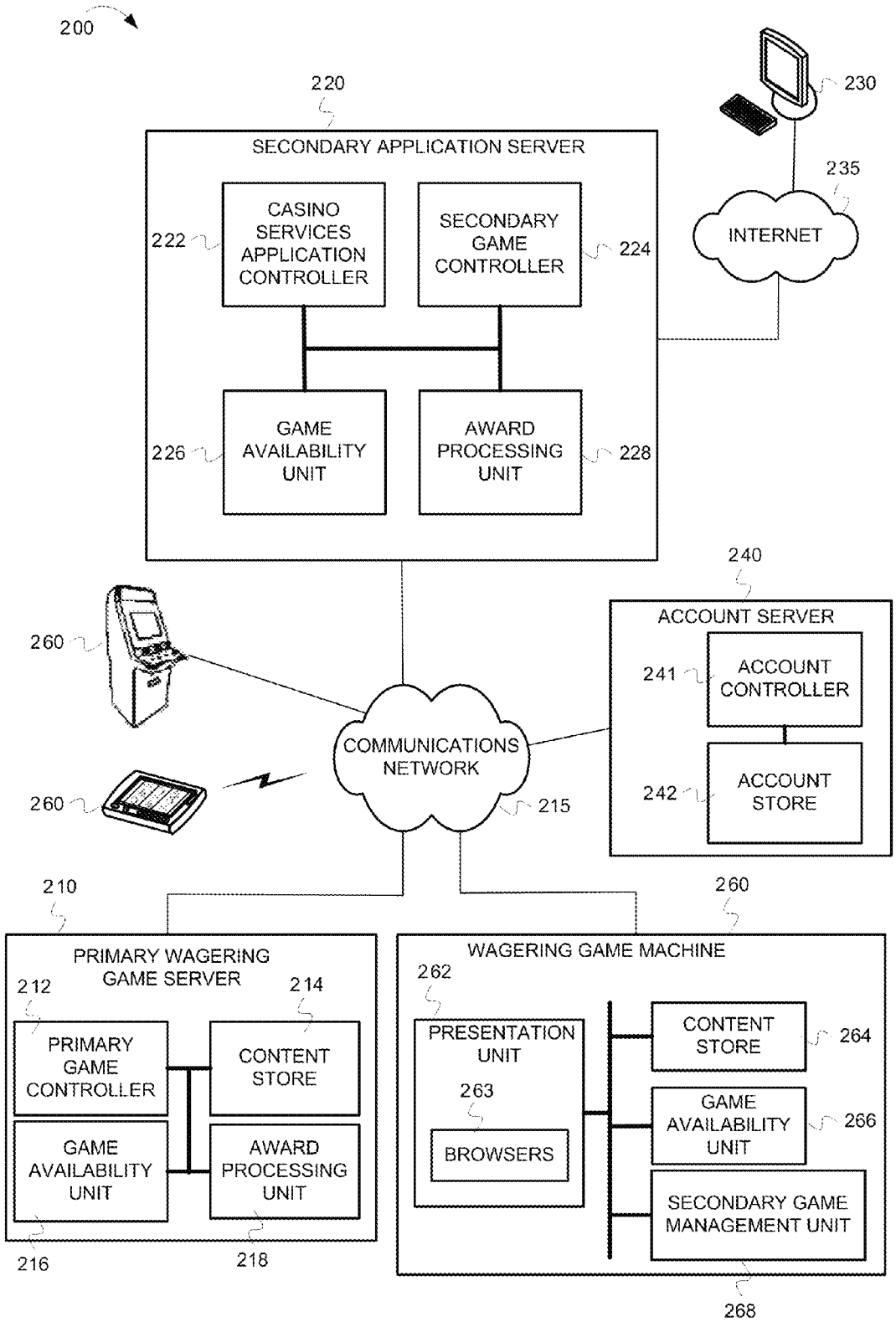
FIG. 2 is a conceptual diagram that illustrates an example of a wagering game system architecture, according to some embodiments.

FIG. 2 is a conceptual diagram that illustrates an example of a wagering game system architecture 200, according to some embodiments. As illustrated, the wagering game system architecture 200 includes a primary wagering game server 210, a secondary application server 220, an account server 240, and a plurality of wagering game machines 260 connected via a communication network 215.

The primary wagering game server 210 is configured to manage and control primary wagering game content for presentation on the wagering game machines 260. Primary wagering game content can include primary wagering games that receive bets, produce game results, and award winning results with money pay outs. Examples of primary wagering game content include primary game play elements that present game play, such as slot reels, poker cards, roulette wheels, etc. The primary wagering game server 210 includes a primary game controller 212 configured to generate (e.g., using a random numbers generator) game results (e.g., win/loss values), including win amounts, for games played on the wagering game machines 260 (e.g., slots, poker, etc.). The primary game controller 212 can communicate the game results to the wagering game machines 260 via the network 215. In some implementations, the primary game controller 212 can also generate random numbers and provide them to the wagering game machines 260 so that the wagering game machines 260 can generate game results. The primary wagering game server 210 can also include a content store 214 configured to store the primary wagering game content.

The primary wagering game server 210 may include a game availability unit 216 for detecting when a primary wagering game is unavailable for play. The game availability unit 216 can also determine why the primary wagering game is unavailable, e.g., due to a software failure, a hardware failure, network issues, unavailability of game content or other game resources, etc. Additionally, the game availability unit 216 can initiate resolution procedures so that the primary wagering game is available for play. For instance, the game availability unit 216 can initiate a procedure for servicing the primary wagering game. In one example, the game availability unit 216 can analyze the problem and automatically repair software issues from the server side. In another example, the game availability unit 216 can determine that the problem may need to be resolved manually by a service technician and may send a notification message to a service department. The game availability unit 216 may also notify the player of the primary wagering game of the availability issues and resolution procedures, e.g., by sending a message to cause the wagering game machine 260 to display information to the player, or by sending information to the player via a text or email message. Furthermore, the game availability unit 216 can implement techniques that maintain the operational state of the primary wagering game when one or more secondary games are unavailable for play. For example, the game availability unit 216 can receive a message from the secondary applications server 220 that a secondary game, which has a pay table that is tied to the primary wagering game, is unavailable for play. In this example, the game availability unit 216 can cause the primary game controller 212 to associate the primary wagering game with a new pay table that is independent of the unavailable secondary game, as will be further described below.

The primary wagering game server 210 may also include an award processing unit 218 for determining identification information for the player of the primary wagering game that is unavailable for play. For example, the award processing unit 218 may determine a casino account number, a hotel account number, a name and address, etc. associated with the player. The award processing unit 218 may then provide an award, depending on the primary game results, to the player using the identification information, as will be further described below. The award processing unit 218 can also notify the player of the game results and award, e.g., via a text message or email.

The secondary application server 220 is configured to manage and control secondary applications implemented within the wagering game system 200. Secondary applications may include secondary games, such as bonus games, side games, etc., which are presented in conjunction with a primary wagering game at the wagering game machines 260. The secondary games can provide monetary awards (e.g., credits) or non-monetary awards (e.g., points, merchandise, discounts, status rewards, perks, etc.) based on the secondary game results. Secondary applications may also include other applications besides games, such as promotional applications, social networking applications, player tracking applications, or other casino services applications that are associated with the wagering game machines 260. In some embodiments, the secondary application server 220 can also manage and control secondary applications that are implemented for online gaming, for example, secondary games that are presented on one or more remote systems 230 (e.g., a personal computer (PC) or a mobile device) to members of an online gaming community via the Internet 235.

The secondary application server 220 may include a casino services application controller 222 and a secondary game controller 224. The secondary game controller 224 may be configured to manage and control secondary games for presentation on the wagering game machines 260. For example, the secondary game controller 224 can generate (e.g., using a random numbers generator) game results for the secondary games, and may also store secondary game content. The casino services application controller 222 can manage and control casino services applications, such as applications that provide players additional entertainment options (e.g., social networking applications), and applications that are implemented for the benefit of the operator (e.g., promotional applications).

The secondary application server 220 may also include a game availability unit 226 and an award processing unit 228. The game availability unit 226 may detect when a secondary game is unavailable for play. The game availability unit 226 can also determine why the secondary game is unavailable, e.g., due to a software failure, a hardware failure, network issues, unavailability of game content or other game resources, etc. Additionally, the game availability unit 226 can initiate resolution procedures so that the secondary game is available for play. For instance, the game availability unit 226 can initiate a procedure for servicing the secondary game. In one example, the game availability unit 226 can analyze the problem and automatically repair software issues from the server side. In another example, the game availability unit 226 can determine that the problem may need to be resolved manually by a service technician and may send a notification message to a service department. The game availability unit 226 may also notify the player of the secondary game of the availability issues and resolution procedures, e.g., by sending a message to cause the wagering game machine 260 to display information to the player or by sending information to the player via a text message or email. Furthermore, the game availability unit 226 can implement techniques that provide the player additional secondary game options when a secondary game is unavailable for play. For example, while a first secondary game is being serviced, the game availability unit 226 can cause the secondary game controller to automatically present a second secondary game that is similar to the first secondary game, suggest additional secondary game options, and/or present another instance of the same secondary game, as will be further described below. The award processing unit 228 can determine identification information for the player of the secondary game that is unavailable for play. For example, the award processing unit 228 may determine a casino account number, a hotel account number, a name and address, etc. associated with the player. The award processing unit 228 may then provides an award, depending on the secondary game results, to the player using the identification information, as will be further described below. The award processing unit 228 can also notify the player of the game results and award, e.g., via a text message or email.

The account server 240 can control player related accounts accessible via wagering game networks and social networks. The account server 240 can store and track player information, such as identifying information (e.g., avatars, screen name, account identification numbers, etc.) or other information like financial account information, social contact information, etc. The account server 240 can contain accounts for social contacts referenced by the player account. The account server 240 can also provide auditing capabilities, according to regulatory rules, and track the performance of players, machines, and servers. The account server 240 can include an account controller 241 configured to control information for a player's account. The account server 240 can also include an account store 242 configured to store information for a player's account.

The plurality of wagering game machines 260 are configured to present primary wagering games, secondary games, and other content for players. As illustrated in FIG. 2, in some implementations, each of the wagering game machines 260 includes a presentation unit 262, a content store 264, a game availability unit 266, and a secondary game management unit 268. The presentation unit 262 is configured to control the presentation of primary wagering games and secondary games on the wagering game machine 260. The presentation unit 262 can include one or more browsers 263 and any other software and/or hardware suitable for presenting audio and video content. It is noted, however, that in other implementations the game content can be presented using other display technologies. The content store 264 can store content to present on the wagering game machine 260. The game availability unit 266 may be configured to detect availability issues, at the wagering game machines, associated with the primary wagering games and the secondary wagering games. The game availability unit 266 can also report the detected availability issues to the primary wagering game server 210 and/or the secondary applications server 220, and provide additional information for the analysis and resolution of the game-related availability issues.

The secondary game management unit 268 is configured to implement a messaging protocol to communicate with the secondary application server 220. In one example, the secondary game management unit 268 may implement the messaging protocol for communicating with the secondary application server 220 via a network socket interface. The secondary game management unit 268 can utilize the messaging protocol to report secondary game events associated with the secondary games being presented on the wagering game machine 260 to the secondary application server 220. In one example, the secondary game management unit 268 can report events that trigger the presentation of secondary games (e.g., max bet, button presses, primary game results), player inputs during secondary games (e.g., button presses, screen touches), secondary game results, etc.

In one embodiment, the wagering game machines 260 can be stationary floor models or handheld mobile models. It is noted, however, that in other embodiments the wagering game machines 260 can include laptops, desktop PCs, mobile phones, personal digital assistants (PDAs), etc. that have access to the network 215.

Each component shown in the wagering game system architecture 200 is shown as a separate and distinct element connected via a communications network 215. However, some functions performed by one component could be performed by other components. For example, the secondary game controller 222 can also be configured to perform some or all of the functions of the game availability unit 226 and/or the award processing unit 228. Furthermore, the components shown may all be contained in one device, but some, or all, may be included in, or performed by multiple devices, as in the configurations shown in FIG. 2 or other configurations not shown. For example, the game availability unit 216, the award processing unit 218, the game availability unit 226, and the award processing unit 228 may be implemented within a game availability server (not shown) coupled to the network 215. Also, although shown as separate servers in the example system architecture of FIG. 2, in other embodiments, the primary wagering game server 210 and the secondary application server 220 described herein can be implemented within the same wagering game server. Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable storage media includes read only memory (ROM), random access memory (RAM), magnetic disk storage media, optical storage media, flash memory machines, and other types of tangible storage medium suitable for storing instructions. Machine-readable transmission media includes any media suitable for transmitting software over a network.

Although FIG. 2 describes some embodiments, the following sections describe many other features and embodiments.

EXAMPLE OPERATIONS

This section describes operations associated with some embodiments. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 3:
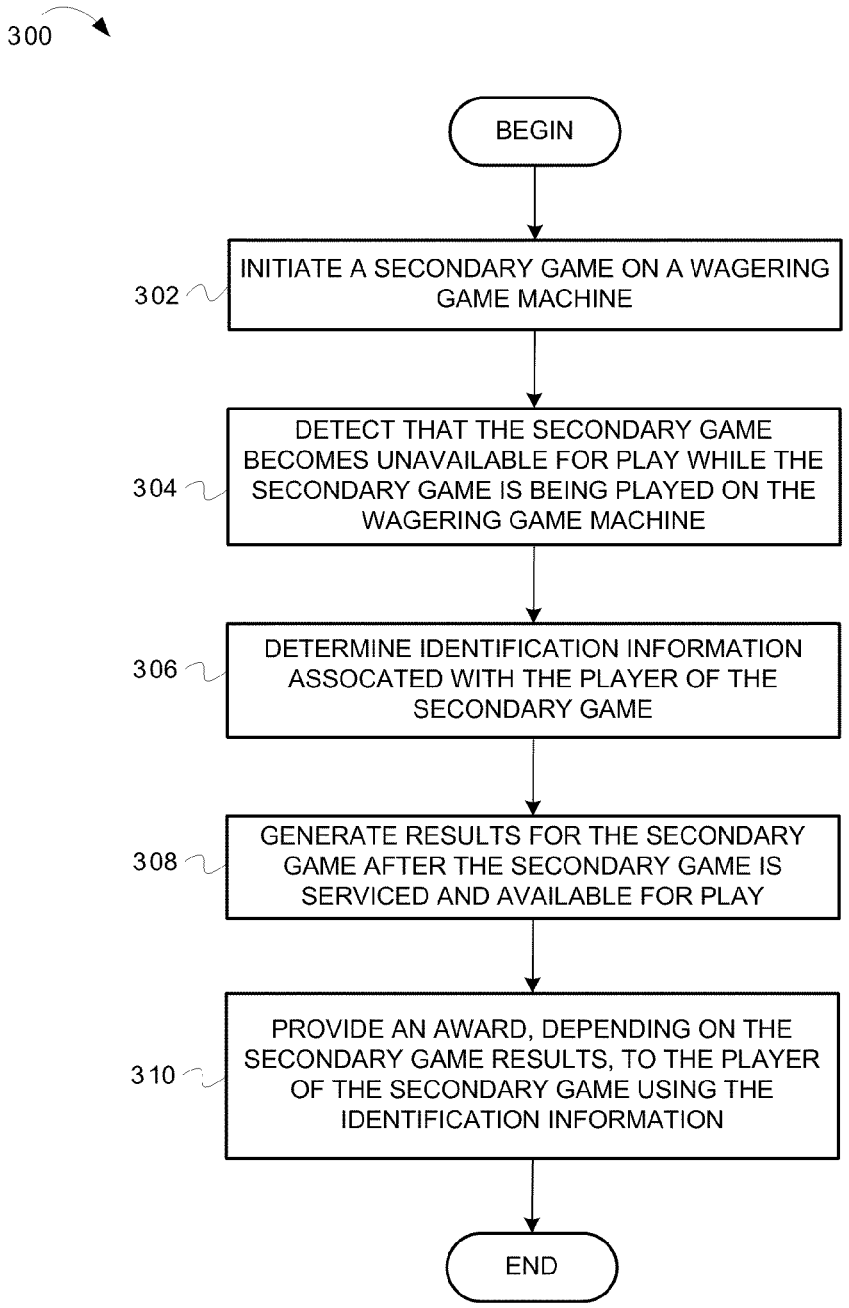
FIG. 3 is a flow diagram illustrating operations for processing an award for a secondary game that becomes unavailable for play, according to some embodiments.
Figure 4:
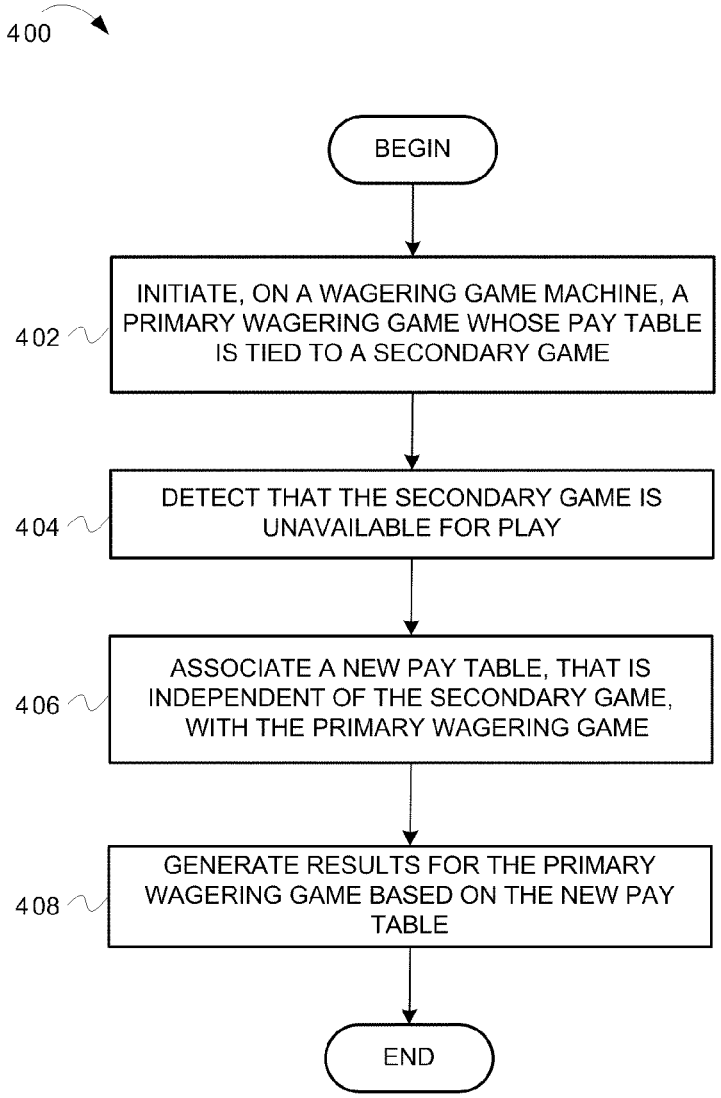
FIG. 4 is a flow diagram illustrating operations for maintaining the operational state of a primary wagering game that is tied to a secondary game when the secondary game becomes unavailable for play, according to some embodiments.
Figure 5:
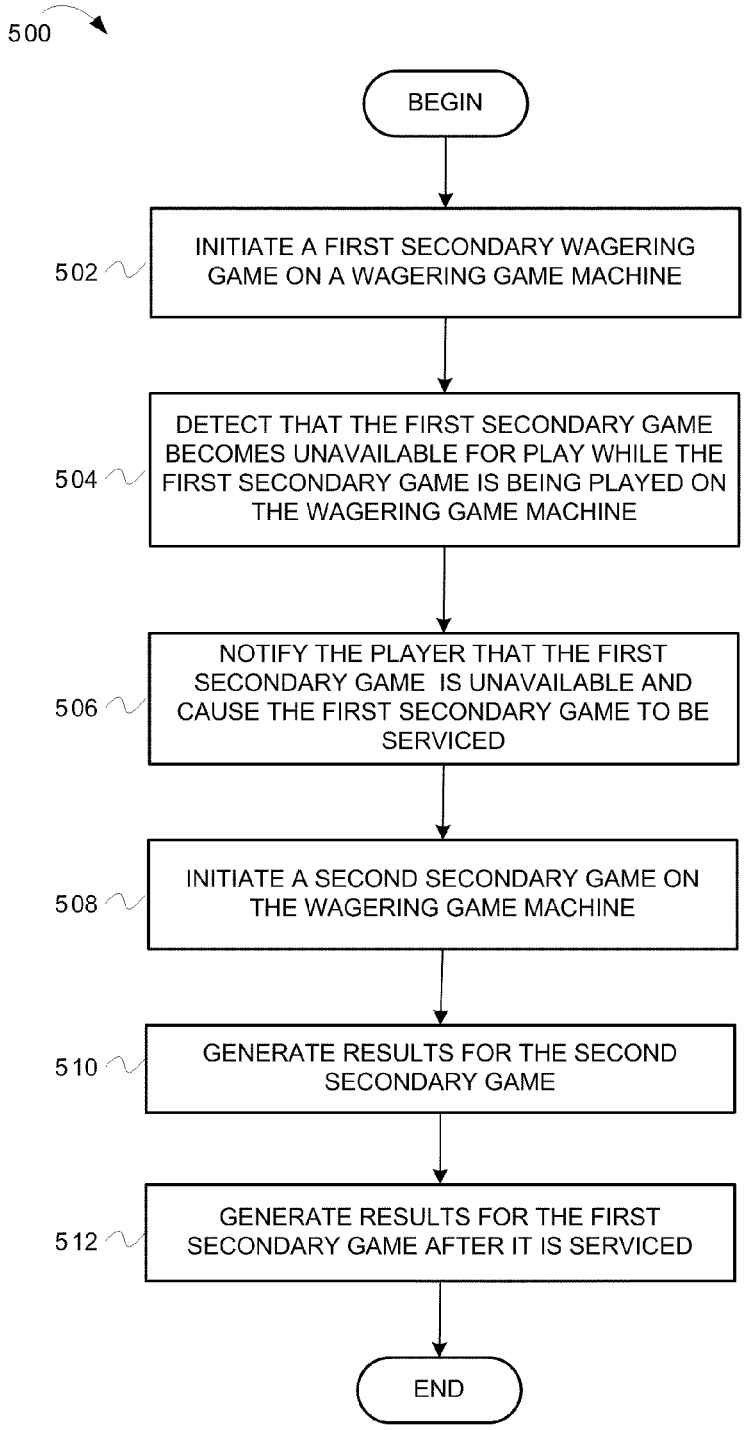
FIG. 5 is a flow diagram illustrating operations for maintaining the operational state of a wagering game machine offering a primary wagering game and multiple secondary games when a secondary game becomes unavailable for play, according to some embodiments.

The following discussion of FIGS. 3-5 will describe various examples of dynamic management of wagering game availability. FIG. 3 describes example mechanisms for processing an award for a wagering game that becomes unavailable for play. FIGS. 4 and 5 describe example mechanisms for maintaining the operational state of a wagering game machine when a wagering game becomes unavailable for play.

FIG. 3 is a flow diagram ("flow") 300 illustrating operations for processing an award for a secondary game that becomes unavailable for play, according to some embodiments. The flow of 300 will be described with reference to the example system architecture of FIG. 2. The flow diagram begins at block 302.

At block 302, the secondary application server 220 initiates a secondary game for presentation on a wagering game machine 260. In one implementation, the secondary game is presented in conjunction with a primary wagering game at the wagering game machine 260. For example, the secondary application server 220 may initiate the secondary game (e.g., a bonus game) after a trigger event in the primary wagering game is detected at the wagering game machine 260 and reported to the secondary application server 220. Trigger events may be predefined game-related events that are detected during game play, such as a predefined number of max bets wagered, predefined game results, a predefined number of games played, etc. In another example, the secondary game may be initiated in response to a player selecting one of a plurality of available secondary games, or in response to a casino-wide jackpot game event. After block 302, the flow continues at block 304.

At block 304, the secondary application server 220 detects that the secondary game becomes unavailable for play while the secondary game is being played on the wagering game machine 260. For example, the secondary game may become unavailable while a player has a bet (e.g., a side bet) in progress for the secondary game. In another example, the bet (or wager) that is in progress may be a bet that the player enters that is shared between the primary wagering game and the secondary game (as will be further described below). The secondary game may be unavailable for play due to a software failure, a hardware failure, network issues, unavailability of game content or other game resources, etc. In one example, the game availability unit 226 of the secondary application server 220 may detect the availability issues associated with the secondary game. In another example, the secondary applications server 220 may detect the availability issues by receiving an error message or other notification from the wagering game machine 260. In some implementations, the secondary application server 220 may also notify the player that the secondary game is unavailable, e.g., by causing the wagering game machine 260 to move the secondary game to one of the corners of the display area and displaying a graphic (or other visual indication) over the game (or the game icon) indicating the game is unavailable. In another example, the secondary application server 220 may also notify the player that the secondary game is unavailable by posting a message on one of the displays of the wagering game machine 260, by graying out the secondary game, by removing the secondary game from the display area, and/or by sending the player a text message. Furthermore, in some implementations, the secondary application server 220 can inform the player of the resolution procedure, i.e., that the game results can be determined later and the player will be provided an award depending on the game results. In one example, the player may be presented with several options while the secondary game is being serviced, e.g., the player may continue playing the primary wagering game, the secondary applications server 220 can present the player another secondary game (e.g., see FIG. 5), or the player may move to another wagering machine 260. After block 304, the flow continues at block 306.

At block 306, the secondary application server 220 determines identification information associated with the player of the secondary game. In some implementations, the secondary application server 220 determines an account number of an account (e.g., casino account) associated with the player of the secondary game. For example, the award processing unit 228 of the secondary application server 220 can send a request message to the account server 240 to obtain the account number, e.g., based on information retrieved from a player card in a card reader of the wagering game machine 260. In some implementations, if an account number is not found for the player of the secondary game, the secondary application server 220 may send a message to cause the wagering game machine 260 to prompt the player for identification information, such as a casino account number, a hotel account number, a checking account number, a savings account number, and/or a name and address. It is noted, however, that in other embodiments the secondary application server 220 may cause the wagering game machine 260 to prompt the player for identification information, e.g., hotel room number, name/address, etc., for a concierge services application. In this embodiment, the award processing unit 228 of the secondary application server 220 may also access and use this identification information when the secondary game becomes unavailable for play. After block 306, the flow continues at block 308.

At block 308, the secondary application server 220 generates results for the secondary game after the secondary game is serviced and available for play. In one example, the secondary game may be unavailable due to a software failure. Before the software failure, the secondary applications server 220 may have initiated the secondary game for presentation to the player, and may have generated random numbers to determine the results of the secondary game. In this example, after the software failure, the secondary application server 220 may service the secondary game (i.e., resolve the software failure), and then generate the secondary game results based on the random numbers that were generated prior to the software failure. It is noted, however, that in some examples the secondary application server 220 may have generated the secondary game results before the availability issues (e.g., software failure), but the results may have not been presented to the player. It is noted, however, that in other embodiments the secondary application server 220 can determine the results for the secondary game after the secondary game is serviced and available for play by other methods. For example, when the secondary application server 220 detects a software failure (or other availability issue), the secondary application server 220 can automatically save game state information, game asset information, random numbers, and other game-related information necessary to restore the secondary game and determine the game results after the secondary game is serviced and available for play. After block 308, the flow continues at block 310.

At block 310, the secondary applications server 220 provides an award, depending on the secondary game results, to the player using the identification information. For example, the award processing unit 228 can credit the award (e.g., monetary value) to the player account on the account server 240 (e.g., casino account) using the account number. In another example, when an account number is not found and the player provides a name and address, the secondary applications server 220 can process the award so that a check is sent to the address provided by the player. In some implementations, the secondary application server 220 can notify the player of the secondary game results and/or the award that was provided to the player, e.g., via a text message, email, or phone call. The mobile phone number and/or the email address of the player may be obtained from the player account on the account server 240, or the player may be prompted for this information, e.g., when the availability issue is detected. After block 310, the flow ends.

In some cases, the primary wagering game server 210 may detect that the primary wagering game becomes unavailable for play, e.g., due to a software failure, a hardware failure, network issues, unavailability of game content or other game resources, etc. In some implementations, the primary wagering game server 210 may implement a dynamic awarding process similar to the process described in FIG. 3 for the secondary application server 220. For example, as was described above with reference to FIG. 2, the game availability unit 216 may detect that the primary wagering game is unavailable for play, the award processing unit 218 may determine identification information associated with the player, the primary game controller 212 may generate the primary wagering game results, and the award processing unit 218 may provide an award, depending on the primary wagering game results, to the player using the identification information.

FIG. 4 is a flow diagram ("flow") 400 illustrating operations for maintaining the operational state of a primary wagering game that is tied to a secondary game when the secondary game becomes unavailable for play, according to some embodiments. The flow of 400 will be described with reference to the example system architecture of FIG. 2. The flow diagram begins at block 402.

At block 402, the primary wagering game server 210 initiates a primary wagering game for presentation on a wagering game machine 260. The primary wagering game includes a pay table that is tied to a secondary game (e.g., a bonus game) associated with the primary wagering game. The primary wagering game may be a wagering game, such as video poker or slots, and the secondary game may be a bonus game, a side game, etc. In some implementations, when the pay table of the primary wagering game is tied to the secondary game, the player's bet for the primary wagering game may be shared between the primary wagering game and the secondary game. In other words, the player may not enter a separate bet for the secondary game. In one implementation, the pay table of the primary wagering game may be tied to the secondary game such that 95% of the bet may be applied towards the primary wagering game results and 5% of the bet may be applied toward the secondary game results. For example, if the player places a bet of $1, $0.95 may be applied toward the primary wagering game results and $0.05 may be applied toward the secondary game results. After block 402, the flow continues at block 404.

At block 404, the primary wagering game server 210 detects that the secondary game is unavailable for play. For example, the game availability unit 216 of the primary wagering game server 210 receives a notification message, or other indication, from the secondary application server 220 that that the secondary game is unavailable for play. In another example, the primary wagering game server 210 may receive a notification message from the game availability unit 266 of the wagering game machine 260. In some embodiments, the primary wagering game server 210 treats the secondary game as unavailable, if the primary wagering game server 210 does not receive communications from the secondary application server 220 for a given time. As described above, the secondary game may be unavailable for play, e.g., due to a software failure, a hardware failure, network issues, unavailability of game content or other game resources, etc. Furthermore, the primary wagering game server 210 may notify the player of the primary wagering game that the secondary game is unavailable for game play, e.g., using the techniques described above with reference to FIG. 3. After block 404, the flow continues at block 406.

At block 406, the primary wagering game server 210 associates a new pay table, that is independent of the secondary game, with the primary wagering game, while the secondary game is being serviced. For example, the primary game controller 212 of the primary wagering game server 210 may associate a new pay table, that applies 100% of the bet amount toward the primary wagering game results, with the primary wagering game. In some implementations, while the secondary game is being serviced, the primary wagering game server 210 can begin offering an instance of the primary wagering game, that is associated with a pay table that is independent of the secondary game, for presentation on the wagering game machine 260. For example, the primary game controller 212 can cause the presentation unit 262 of the wagering game machine 260 to begin presenting an instance of the primary wagering game with a pay table that is independent of the secondary game. These resolution procedures can maintain the operational state of the primary wagering game when the secondary game is unavailable, and provide the player the option to continue playing the primary wagering game with little or no interruptions. In some implementations, the primary wagering game server 210 may associate a new pay table, that is independent of the secondary game, with the primary wagering game at any time, e.g., when the wagering game machine 260 is idle, when the primary wagering game and the secondary game are idle, or while the player is playing the primary wagering game. In other implementations, the primary wagering game server 210 may associate a new pay table, that is independent of the secondary game, with the primary wagering game only when a bet is not in progress, e.g., when the wagering game machine 260 is idle, or when the primary wagering game and the secondary game are idle (or in between games). In some implementations, after the secondary game is serviced, the primary wagering game server 210 can provide the player the option (e.g., via the presentation unit 262) to continue with the current instance of the primary wagering game or to revert back to the instance of the primary wagering game that is tied with the secondary game. After block 406, the flow continues at block 408.

At block 408, the primary wagering game server 210 generates results for the primary wagering game based on the new pay table that is independent of the secondary game. For example, the primary game controller 212 may generate the primary wagering game results and cause the presentation unit 262 to present the results to the player on one of the displays of the wagering game machine 260. After block 408, the flow ends.

It is noted, however, that in other embodiments, when the primary wagering game server 210 detects that the secondary game is unavailable for play, the primary wagering game server 210 can begin offering an instance of the primary wagering game with a pay table that is independent of the secondary game that is unavailable for play, but that is tied to a different secondary game.

FIG. 5 is a flow diagram ("flow") 500 illustrating operations for maintaining the operational state of a wagering game machine offering a primary wagering game and multiple secondary games when a secondary game becomes unavailable for play, according to some embodiments. The flow of 500 will be described with reference to the example system architecture of FIG. 2. The flow diagram begins at block 502.

At block 502, the secondary application server 220 initiates a first secondary game for presentation on a wagering game machine 260. In one implementation, the first secondary game is presented in conjunction with a primary wagering game at the wagering game machine 260. After block 502, the flow continues at block 504.

At block 504, the secondary application server 220 detects that the first secondary game becomes unavailable for play while the first secondary game is being played on the wagering game machine 260. For example, the first secondary game may become unavailable while a player has a bet (e.g., a side bet) in progress for the first secondary game. The first secondary game may be unavailable for play due to a software failure, a hardware failure, network issues, unavailability of game content or other game resources, etc. In one example, the game availability unit 226 of the secondary application server 220 may detect the availability issues associated with the first secondary game. In another example, the secondary applications server 220 may detect the availability issues by receiving an error message or other notification from the wagering game machine 260. After block 504, the flow continues at block 506.

At block 506, the secondary application server 220 notifies the player that the first secondary game is unavailable for play and causes the first secondary game to be serviced. In some implementations, the game availability unit 226 of the secondary application server 220 causes the wagering game machine 260 to display a minimized version of first secondary game (or a game icon) in one of the corners of the display area. The game availability unit 266 may also display a graphic (or other visual indication) over the game (or the game icon) to indicate the game is unavailable and being serviced. In one example, to indicate the game is unavailable and being serviced, the game icon can be grayed out, a red circle and line can be superimposed over the game icon, text can be superimposed over the game icon, etc. In another example, the game icon can be removed from the display area. In one example, if the player tries to select the first secondary game while it is being serviced, the wagering game machine 260 may display a message indicating the first secondary game is unavailable and may suggest other secondary games to the player, as will be described further below. In some implementations, the secondary applications server 220 can send the player a text message, email, etc. to notify the player that the first secondary game is unavailable. Furthermore, in some implementations, the secondary applications server 220 can initiate a procedure for servicing the first secondary game. In one example, the game availability unit 226 can analyze the problem and automatically repair software issues from the server side. In another example, the game availability unit 226 can determine that the problem may need to be resolved manually by a service technician and may send a notification message to a service department. In some implementations, the secondary application server 220 can inform the player of the resolution procedure, i.e., that the game results can be determined later and the player will be provided an award depending on the game results, for example, as was described above with reference to FIG. 3. After block 506, the flow continues at block 508.

At block 508, the secondary application server 220 initiates a second secondary game for presentation on the wagering game machine 260. For example, the game availability unit 226 may cause the secondary game controller 224 to initiate a second secondary game for presentation on the wagering game machine 260. In some implementations, the secondary application server 220 may initiate a second secondary game that is similar to the first secondary game (e.g., similar game content, theme, etc.), or may be a different instance of the first secondary game that is available for play. In some implementations, the secondary application server 220 may select a second secondary game for presentation on the wagering game machine 260 based on a game play history of the player and/or based on player preferences specified by the player. In some implementations, the secondary application server 220 may suggest a plurality of additional secondary games based on game play history and/or player preferences. In one example, the secondary application server 220 may cause the wagering game machine 260 to display a visual indication of the plurality of additional secondary games. The player may then select one or more of the suggested secondary games for play while the first secondary game is being serviced. Furthermore, while the first secondary game is being serviced and one or more additional secondary games are being presented, the player may be provided the option to continue playing the primary wagering game. After block 508, the flow continues at block 510.

At block 510, the secondary application server 220 generates the results for the second secondary game. For example, the secondary game controller 224 generates the results for the second secondary game and causes the wagering game machine 260 to present the results. After block 510, the flow continues at block 512.

At block 512, after the first secondary game is serviced and available for play, the secondary application server 220 generates the results for the first secondary game. For example, the secondary game controller 224 generates the results for the first secondary game and causes the wagering game machine 260 to present the results. After the block 512, the flow ends.

It is noted that the secondary game may also become unavailable for play when the game is idle, e.g., when the secondary game is not being presented on the wagering game machine 260, when a bet for the secondary game is not in progress, when a player is playing a different secondary game, etc. In some embodiments, if a secondary game becomes unavailable for play when the game is idle, the secondary application server 220 may cause the wagering game machine 260 to remove the unavailable secondary game from the display area and/or the game menu area. For example, the secondary application server 220 may send a message instructing the secondary game management unit 268 to replace the unavailable secondary game with another secondary game. In one example, the unavailable secondary game can be automatically replaced with a secondary game that has similar game content. In other examples, the unavailable secondary game can be replaced with a new secondary game offering, or a secondary game that has promotional free spins. As described above, in some cases, the secondary game may become unavailable while a player is playing a primary wagering game and other secondary games. In one example, the unavailable secondary game can be automatically replaced with one or more available secondary games based on the player's game play history and/or based on game preferences specified by the player (e.g., in his player profile). For example, if the player's game play history indicates that the player has played a certain picking game several times, the unavailable secondary game can be replaced with the picking game. In another example, the secondary application server 220 may cause the wagering game machine to suggest one or more available secondary games based on the player's game play history and/or based on the player's game preferences. In this example, the wagering game machine 260 may present the player several secondary game options to replace the unavailable secondary game, and the player can select one or more of the options.

In some embodiments, if a primary wagering game becomes unavailable for play when the game is active or idle, the primary wagering game server 210 and/or the wagering game machine 260 may allow the player to continue playing secondary games on the wagering game machine 260 while the primary wagering game is being serviced.

Additional Example Operating Environments

This section describes example operating environments, systems and networks, and presents structural aspects of some embodiments.

Wagering Game Machine Architecture

Figure 6:
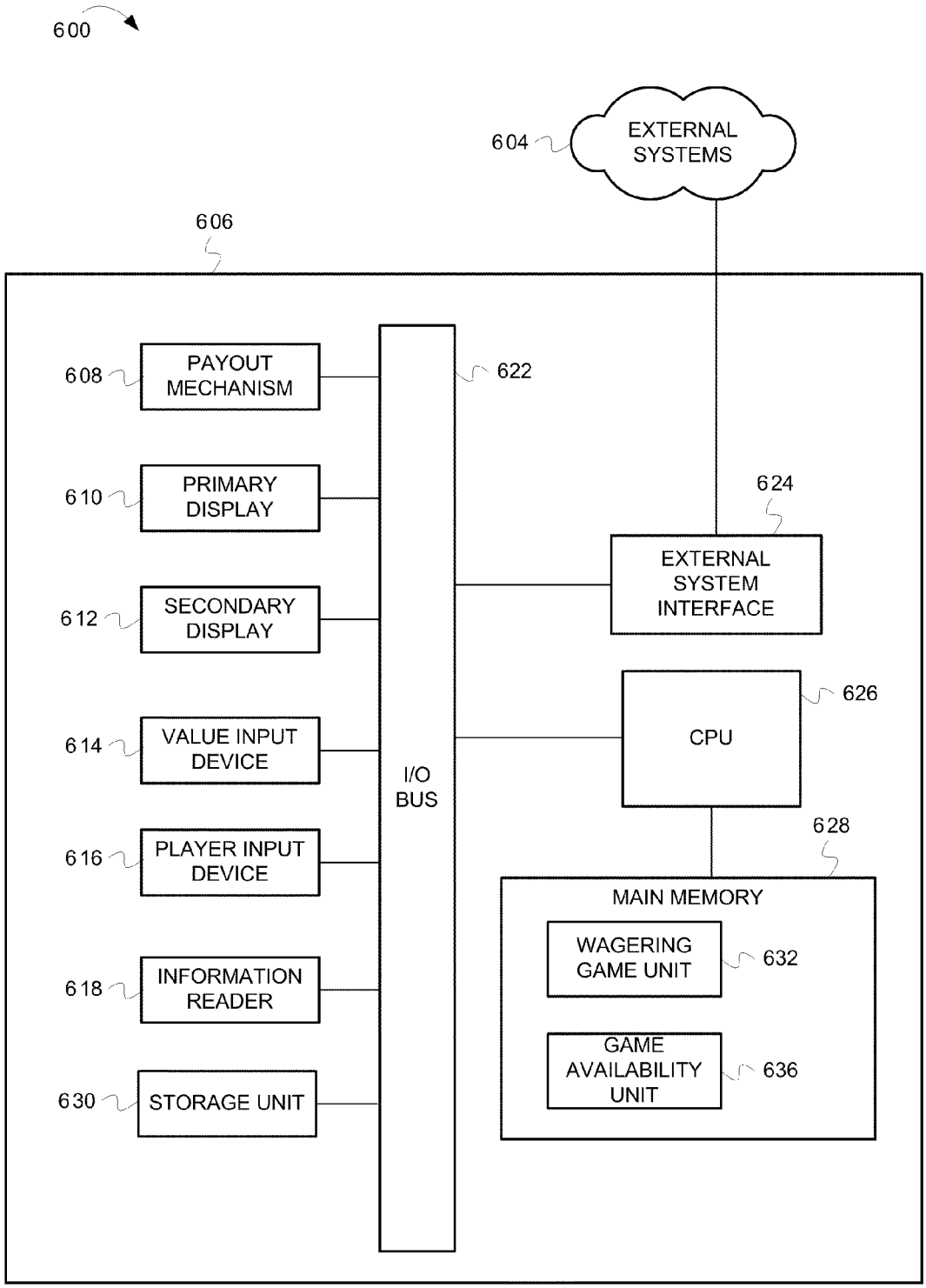
FIG. 6 is a conceptual diagram that illustrates an example of a wagering game machine architecture, according to some embodiments.

FIG. 6 is a conceptual diagram that illustrates an example of a wagering game machine architecture 600, according to some embodiments. In FIG. 6, the wagering game machine architecture 600 includes a wagering game machine 606, which includes a central processing unit (CPU) 626 connected to main memory 628. The CPU 626 can include any suitable processor, such as an Intel® Pentium processor, Intel® Core 2 Duo processor, AMD Opteron™ processor, or UltraSPARC processor. The main memory 628 includes a wagering game unit 632 and a game availability unit 636. In some embodiments, the wagering game unit 632 can present wagering games, such as video poker, video black jack, video slots, video lottery, reel slots, etc., in whole or part. The game availability unit 636 can implement techniques for dynamic management of wagering game availability, e.g., as described above with reference to FIGS. 1-5.

The CPU 626 is also connected to an input/output ("I/O") bus 622, which can include any suitable bus technologies, such as an AGTL+frontside bus and a PCI backside bus. The I/O bus 622 is connected to a payout mechanism 608, primary display 610, secondary display 612, value input device 614, player input device 616, information reader 618, and storage unit 630. The player input device 616 can include the value input device 614 to the extent the player input device 616 is used to place wagers. The I/O bus 622 is also connected to an external system interface 624, which is connected to external systems (e.g., wagering game networks). The external system interface 624 can include logic for exchanging information over wired and wireless networks (e.g., 802.11 g transceiver, Bluetooth transceiver, Ethernet transceiver, etc.)

In some embodiments, the wagering game machine 606 can include additional peripheral devices and/or more than one of each component shown in FIG. 6. For example, in some embodiments, the wagering game machine 606 can include multiple external system interfaces 624 and/or multiple CPUs 626. In some embodiments, any of the components can be integrated or subdivided.

In some embodiments, the wagering game machine 606 includes an online gaming module 637. The online gaming module 637 can process communications, commands, or other information, where the processing can control and present online wagering games.

Furthermore, any component of the wagering game machine 606 can include hardware, firmware, and/or machine-readable media including instructions for performing the operations described herein.

Example Wagering Game Machines

Figure 7:
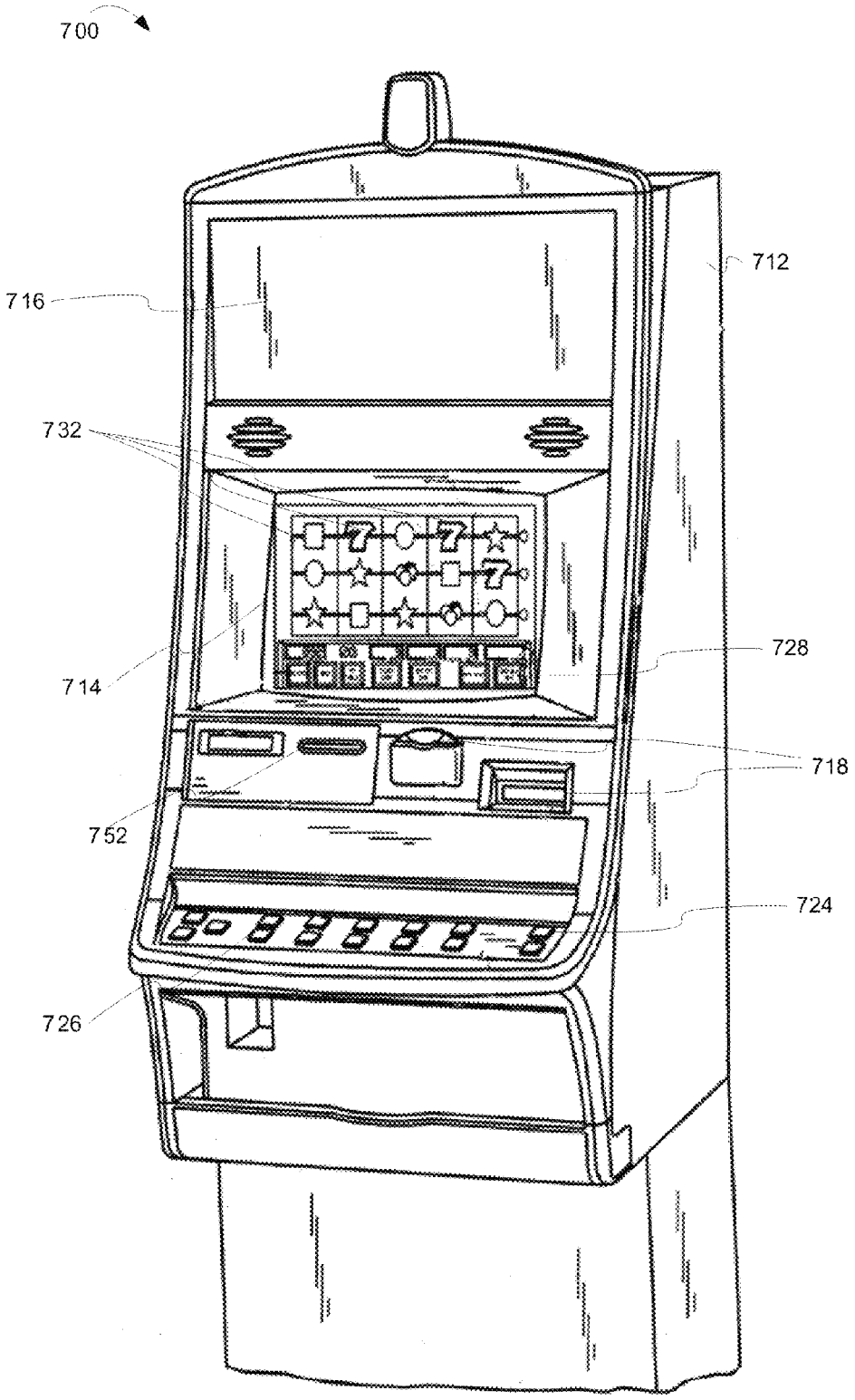
FIG. 7 is a perspective view of a wagering game machine, according to example embodiments.

FIG. 7 is a perspective view of a wagering game machine, according to example embodiments. Referring to FIG. 7, a wagering game machine 700 is used in gaming establishments, such as casinos. In some embodiments, the wagering game machine 700 can implement at least part of the functionality described above with reference to FIGS. 1-5, e.g., for dynamic management of wagering game availability.

According to embodiments, the wagering game machine 700 can be any type of wagering game machine and can have varying structures and methods of operation. For example, the wagering game machine 700 can be an electromechanical wagering game machine configured to play mechanical slots, or it can be an electronic wagering game machine configured to play video casino games, such as blackjack, slots, keno, poker, blackjack, roulette, etc.

The wagering game machine 700 comprises a housing 712 and includes input devices, including value input devices 718 and a player input device 724. For output, the wagering game machine 700 includes a primary display 714 for displaying information about a basic wagering game. In some implementations, the primary display 714 can also display information about a bonus wagering game and a progressive wagering game. The wagering game machine 700 also includes a secondary display 716 for displaying bonus wagering games, wagering game events, wagering game outcomes, and/or signage information. While some components of the wagering game machine 700 are described herein, numerous other elements can exist and can be used in any number or combination to create varying forms of the wagering game machine 700.

The value input devices 718 can take any suitable form and can be located on the front of the housing 712. The value input devices 718 can receive currency and/or credits inserted by a player. The value input devices 718 can include coin acceptors for receiving coin currency and bill acceptors for receiving paper currency. Furthermore, the value input devices 718 can include ticket readers or barcode scanners for reading information stored on vouchers, cards, or other tangible portable storage devices. The vouchers or cards can authorize access to central accounts, which can transfer money to the wagering game machine 700.

The player input device 724 comprises a plurality of push buttons on a button panel 726 for operating the wagering game machine 700. In addition, or alternatively, the player input device 724 can comprise a touch screen 728 mounted over the primary display 714 and/or secondary display 716.

The various components of the wagering game machine 700 can be connected directly to, or contained within, the housing 712. Alternatively, some of the wagering game machine's components can be located outside of the housing 712, while being communicatively coupled with the wagering game machine 700 using any suitable wired or wireless communication technology.

The operation of the basic wagering game can be displayed to the player on the primary display 714. The primary display 714 can also display a bonus game associated with the basic wagering game. The primary display 714 can include a cathode ray tube (CRT), a high resolution liquid crystal display (LCD), a plasma display, light emitting diodes (LEDs), or any other type of display suitable for use in the wagering game machine 700. Alternatively, the primary display 714 can include a number of mechanical reels to display the outcome. In FIG. 7, the wagering game machine 700 is an "upright" version in which the primary display 714 is oriented vertically relative to the player. Alternatively, the wagering game machine can be a "slant-top" version in which the primary display 714 is slanted at about a thirty-degree angle toward the player of the wagering game machine 700. In yet another embodiment, the wagering game machine 700 can exhibit any suitable form factor, such as a free standing model, bartop model, mobile handheld model, or workstation console model.

A player begins playing a basic wagering game by making a wager via the value input device 718. The player can initiate play by using the player input device's buttons or touch screen 728. The basic game can include arranging a plurality of symbols along a payline 732, which indicates one or more outcomes of the basic game. Such outcomes can be randomly selected in response to player input. At least one of the outcomes, which can include any variation or combination of symbols, can trigger a bonus game.

In some embodiments, the wagering game machine 700 can also include an information reader 752, which can include a card reader, ticket reader, bar code scanner, RFID transceiver, or computer readable storage medium interface. In some embodiments, the information reader 752 can be used to award complimentary services, restore game assets, track player habits, etc.

GENERAL

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the inventive subject matter, which are defined only by the appended claims. Each of the embodiments described herein are contemplated as falling within the inventive subject matter, which is set forth in the following claims.

The invention claimed is:

1. A computer-implemented method comprising:

initiating, at a wagering game server of a wagering game system, a secondary game for presentation on a wagering game machine of the wagering game system, wherein the secondary game is associated with a primary wagering game being presented on the wagering game machine, and wherein results for the secondary game are generated on the wagering game server;

detecting, at the wagering game server, that the secondary game becomes unavailable for play after a bet associated with the secondary game is in progress while the secondary game is being presented on the wagering game machine;

determining, at the wagering game server, identification information associated with a player of the primary wagering game and the secondary game;

determining, at the wagering game server, results for the secondary game associated with the player after the secondary game is available for play after service has been performed in response to the secondary game becoming unavailable for play; and providing an award, depending on the results for the secondary game, to the player using the identification information.

2. The method of claim 1, wherein said detecting that the secondary game becomes unavailable for play comprises one of detecting a hardware failure, a software failure, a network failure, and unavailability of game content associated with the secondary game.

3. The method of claim 1, wherein said determining identification information associated with the player of the primary wagering game and the secondary game comprises determining an account number of an account associated with the player of the secondary game, and wherein said providing the award comprises depositing monetary value into the account associated with the player depending on the results for the secondary game.

4. The method of claim 3, wherein, if an account number is not found for the player of the secondary game, said determining identification information associated with the player of the primary wagering game and the secondary game further comprises causing the wagering game machine to prompt the player for a name and address, and receiving a player input including the name and address from the wagering game machine, and wherein said providing the award comprises processing a monetary award, depending on the results for the secondary game, for the player to cause a check to be sent to the name and address that was provided by the player.

5. The method of claim 3, wherein the account associated with the player of the secondary game comprises one of a casino player account, a savings account, a checking account, and a hotel account.

6. The method of claim 1, further comprising causing the secondary game to be serviced in response to detecting that the secondary game becomes unavailable for play.

7. The method of claim 1, further comprising sending at least one of a text message and an email to notify the player that the results associated with the secondary game have been determined, and the award has been provided to the player, depending on the results for the secondary game.

8. The method of claim 1, further comprising, in response to detecting that the secondary game is unavailable for play, initiating a different secondary game for presentation on the wagering game machine.

9. The method of claim 1, further comprising, in response to detecting that the secondary game is unavailable for play:

causing the wagering game machine to display a visual indication of one or more secondary games that are available for play;

receiving a player input selecting one of the one or more secondary games; and initiating the selected one of the one or more secondary games for presentation on the wagering game machine.

10. The method of claim 1, wherein determining, at the wagering game server, results for the secondary game includes determining the results after the player has left the wagering game machine.

11. The method of claim 1, wherein providing the award includes providing the award after the player has left the wagering game machine.

12. The method of claim 1, further comprising:

saving, at the wagering game server, the state of the secondary game; and restoring, at the wagering game server, the state of the secondary game using the saved state after the second game is available for play.

13. The method of claim 12, wherein the saved state of the secondary game includes the output of a random number generator, and wherein determining the results of the secondary game includes using the output of the random number generator is used to determine the results.

14. A wagering game server of a wagering game system, the wagering game server comprising:

a secondary game controller configured to initiate a secondary game for presentation on a wagering game machine of the wagering game system, wherein the secondary game is associated with a primary wagering game being presented on the wagering game machine;

a game availability unit configured to detect that the secondary game becomes unavailable for play after a bet associated with the secondary game is in progress while the secondary game is being presented on the wagering game machine;

an award processing unit configured to determine identification information associated with a player of the primary wagering game and the secondary game;

wherein the secondary game controller is further configured to determine results for the secondary game associated with the player after the secondary game is available for play after service has been performed in response to the secondary game becoming unavailable for play; and wherein the award processing unit is further configured to provide an award, depending on the results for the secondary game, to the player using the identification information.

15. The wagering game server of claim 14, wherein the award processing unit is configured to determining an account number of an account associated with the player of the secondary game, and configured to deposit monetary value into the account associated with the player, depending on the results for the secondary game.

16. The wagering game server of claim 15, wherein, if an account number is not found for the player of the secondary game, the award processing unit is configured to:

cause the wagering game machine to prompt the player for a name and address;

receive a player input including the name and address from the wagering game machine; and process a monetary award, depending on the results for the secondary game, for the player of the secondary game to cause a check to be sent to the name and address that was provided by the player.

17. The wagering game server of claim 14, wherein the game availability unit is further configured to cause the secondary game to be serviced in response to detecting that the secondary game becomes unavailable for play.

18. The wagering game server of claim 14, wherein the award processing unit is further configured to send at least one of a text message and an email to notify the player that the results associated with the secondary game have been determined, and the award has been provided to the player, depending on the results for the secondary game.

19. The wagering game server of claim 14, wherein, in response to the game availability unit detecting that the secondary game is unavailable for play, the secondary game controller is configured to:

cause the wagering game machine to display a visual indication of one or more secondary games that are available for play; and initiate one of the one or more secondary games for presentation on the wagering game machine based on a player input received from the wagering game machine.

20. One or more tangible non-transitory machine-readable storage media, having instructions stored therein, which, when executed by one or more processors causes the one or more processors to perform operations that comprise:

initiating a secondary game for presentation on a wagering game machine of a wagering game system, wherein the secondary game is associated with a primary wagering game being presented on the wagering game machine;

detecting that the secondary game becomes unavailable for play after a bet associated with the secondary game is in progress while the secondary game is being presented on the wagering game machine;

determining an account number of an account associated with a player of the primary wagering game and the secondary game;

determining results for the secondary game associated with the player after the secondary game is available for play after service has been performed in response to the secondary game becoming unavailable for play; and depositing monetary value into the account associated with the player depending on the results for the secondary game.

21. The tangible non-transitory machine-readable storage media of claim 20, wherein, if an account number is not found for the player of the secondary game, the operations further comprise causing the wagering game machine to prompt the player for a name and address, receiving a player input including the name and address from the wagering game machine, and processing a monetary award, depending on the results for the secondary game, for the player of the secondary game to cause a check to be sent to the name and address that was provided by the player.

* * * * *